US012798745B2

(12) United States Patent
Takeda et al.

(10) Patent No.: US 12,798,745 B2
(45) Date of Patent: Nov. 17, 2026

(54) SHIP PROPULSION DEVICE

(71) Applicant: Panasonic Intellectual Property Management Co., Ltd., Osaka (JP)

(72) Inventors: Mutsuhiko Takeda, Kyoto (JP); Shinya Geshi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 471 days.

(21) Appl. No.: 18/262,204

(22) PCT Filed: Jan. 18, 2022

(86) PCT No.: PCT/JP2022/001518

§ 371 (c)(1),
(2) Date: Jul. 20, 2023

(87) PCT Pub. No.: WO2022/163424

PCT Pub. Date: Aug. 4, 2022

(65) Prior Publication Data

US 2024/0101240 A1 Mar. 28, 2024

(30) Foreign Application Priority Data

Jan. 29, 2021 (JP) ..... 2021-013078

(51) Int. Cl.
*B63H 20/26* (2006.01)
*B63H 20/28* (2006.01)

(52) U.S. Cl.
CPC ..... *B63H 20/26* (2013.01); *B63H 20/28* (2013.01)

(58) Field of Classification Search
CPC ..... B63H 20/26; B63H 20/28
(Continued)

(56) References Cited

U.S. PATENT DOCUMENTS 3,431,882 A * 3/1969 Irgens ..... F02B 75/20 123/41.31
4,354,849 A * 10/1982 Sanmi ..... F01P 3/202 440/89 R (Continued)

FOREIGN PATENT DOCUMENTS

JP 07-101390 4/1995
JP 09-189226 7/1997

(Continued)

OTHER PUBLICATIONS

Extended Supplementary European Search Report dated Jun. 27, 2024, issued in counterpart Application No. 22745647.2. (9 pages).

(Continued)

*Primary Examiner* — T. Scott Fix
(74) *Attorney, Agent, or Firm* — WHDA, LLP

(57) ABSTRACT

A watercraft propulsion device includes: a motor driving a propulsion unit; a battery supplying electric power to the motor; and a gas flow passage including one end communicating with the battery and another end communicating with a region that is outside a watercraft hull and is located lower than an upper end of a shell panel disposed at an edge of the watercraft hull, the gas flow passage exhausting a gas ejected from the battery from the other end to outside of the watercraft hull.

5 Claims, 2 Drawing Sheets

(58) Field of Classification Search
USPC ..... 440/6
See application file for complete search history.

(56) References Cited

U.S. PATENT DOCUMENTS

| | | | | |
|---|---|---|---|---|
| 5,514,014 | A | 5/1996 | Ogino et al. | |
| 5,529,520 | A | 6/1996 | Iwashita et al. | |
| 5,556,312 | A | 9/1996 | Ogino | |
| 5,556,313 | A | 9/1996 | Ogino | |
| 5,597,334 | A | 1/1997 | Ogino | |
| 5,803,023 | A | 9/1998 | Takahashi et al. | |
| 10,760,470 | B2 * | 9/2020 | Li | H02K 1/187 |
| 2010/0248561 | A1 | 9/2010 | Daikoku | |
| 2014/0287283 | A1 | 9/2014 | Kimpara et al. | |
| 2015/0232163 | A1 * | 8/2015 | Hartmeyer | B63H 21/17 440/88 M |
| 2015/0266558 | A1 | 9/2015 | Biebach et al. | |
| 2017/0015397 | A1 | 1/2017 | Mitchell et al. | |
| 2020/0377186 | A1 | 12/2020 | Thompson et al. | |

FOREIGN PATENT DOCUMENTS

| | | | |
|---|---|---|---|
| JP | 2005-162055 | | 6/2005 |
| JP | 2006-182264 | A | 7/2006 |
| JP | 2014-186853 | | 10/2014 |
| WO | 2017/011475 | A1 | 1/2017 |

OTHER PUBLICATIONS

International Search Report of PCT application No. PCT/JP2022/001518 dated Apr. 5, 2022.
English Translation of Search Report dated Dec. 5, 2025, issued in counterpart CN Application No. 202280011616.1.(3 pages).

* cited by examiner

SHIP PROPULSION DEVICE

CROSS-REFERENCE TO RELATED APPLICATIONS

This application is a U.S. national stage application of the PCT International Application No. PCT/JP2022/001518 filed on Jan. 18, 2022, which claims the benefit of foreign priority of Japanese patent application No. 2021-013078 filed on Jan. 29, 2021, the contents all of which are incorporated herein by reference.

BACKGROUND

Technical Field

The present disclosure relates to a watercraft propulsion device.

Background Art

Watercraft propulsion devices, such as outboard motors, generally employ internal combustion engines, such as gasoline engines, as their motive power source. On the other hand, in recent years, watercraft propulsion devices employing an electric motor as the motive power source have drawn attention from the perspective of, for example, reducing environmental load (for example, see PTL 1). An electrically powered outboard motor disclosed in PTL 1 is furnished with an electric motor for rotating a propeller and a power supply device for supplying electric power to the electric motor. The power supply device has a structure in which a battery pack is accommodated in a battery pack holder.

CITATION LIST

Patent Literature

PTL 1: Japanese Patent Unexamined Publication No. 2014-186853

SUMMARY

When a battery inside the battery pack ignites due to an internal short circuit or other causes, a large amount of high temperature and high pressure toxic gas may be exhausted from the battery pack. Meanwhile, a watercraft propulsion device may be disposed at a position close to a crew or passenger of the watercraft. For this reason, further improvements in safety are needed for the watercraft propulsion device from the viewpoint of allowing the gas to be exhausted from the battery pack.

The present disclosure has been made in view of the foregoing and other problems, and it is an object of the disclosure to provide a technique to improve safety of electrically powered watercraft propulsion devices.

An embodiment of the present disclosure may be a watercraft propulsion device.

This device includes: a motor that drives a propulsion unit; a battery that supplies electric power to the motor; and a gas flow passage including one and another end, the one end communicating with the battery and the other end communicating with a region that is outside a watercraft hull and is located lower than an upper end of a shell panel disposed at an edge of the watercraft hull, the gas flow passage exhausting a gas ejected from the battery from the other end to outside of the watercraft hull.

Any combinations of the above-described constituent elements, and any modifications to expressions in the present disclosure made among methods, devices, systems, etc., are also valid as aspects of the present disclosure.

According to the present disclosure, it is possible to improve safety of electrically powered watercraft propulsion devices.

DESCRIPTION OF EMBODIMENTS

Figure 1:
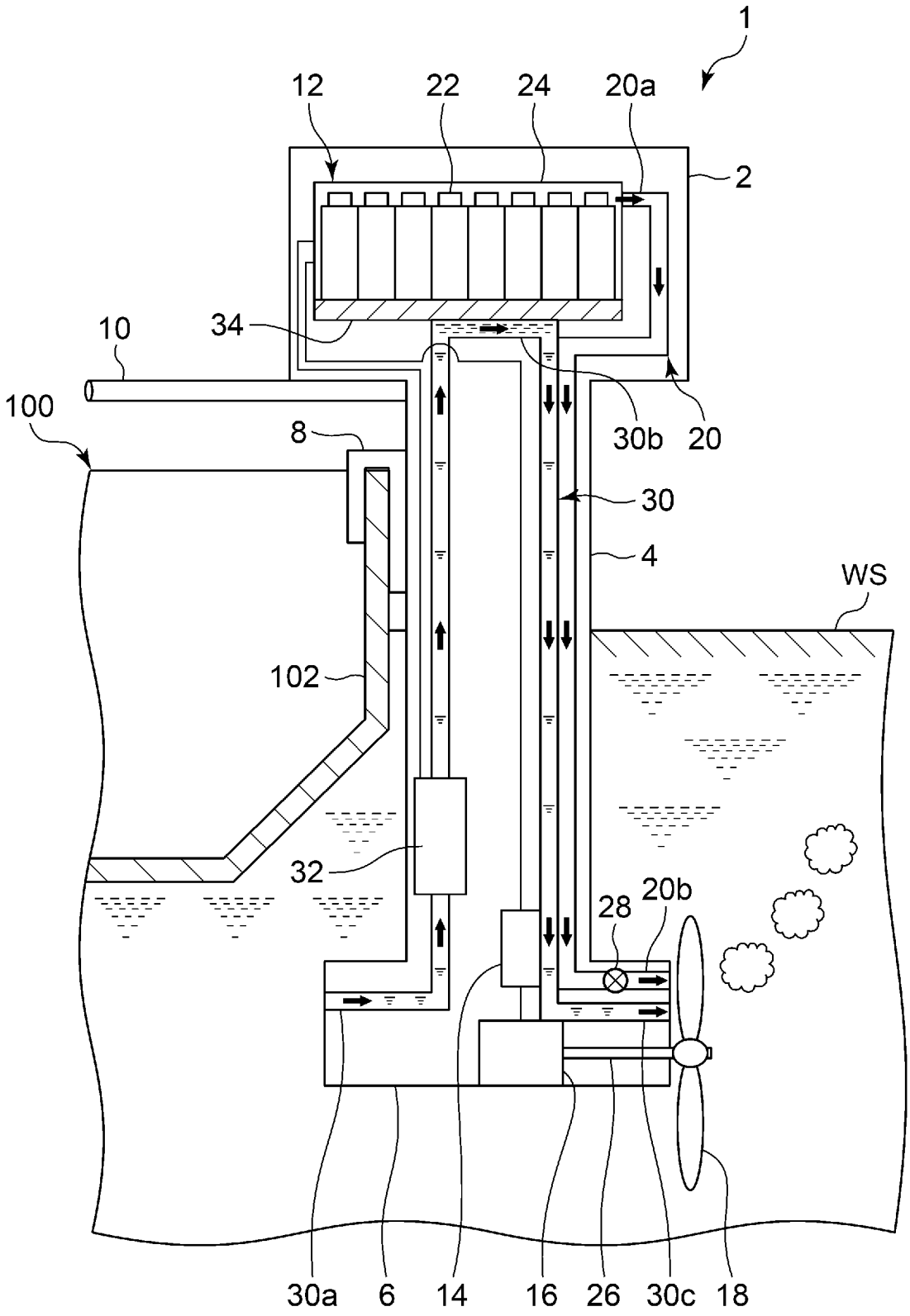
FIG. 1 is a schematic view of a watercraft propulsion device.

Hereafter, the present disclosure will be described based on exemplary embodiments thereof with reference to the drawings. The following exemplary embodiments are not intended to limit the present disclosure but merely illustrative of the present disclosure, and any of the features described in the exemplary embodiments and any combination thereof are not necessarily essential to the present disclosure. In the drawings, same or similar elements, members, and processes are designated by the same reference signs, and the description thereof will not be repeated as appropriate. Moreover, the sizes and shapes of the components illustrated in the drawings are merely exemplary for convenience in illustration and not to be construed as limiting unless otherwise stated. Furthermore, when ordinal terms such as first, second, and the like are used in the present description and claims, such terms do not indicate or imply any sequential order or any order of importance but are used to distinguish one element from another element. In addition, some or parts of the members that are not significant in illustrating the exemplary embodiments may not be depicted in the drawings.

FIG. 1 is a schematic view of watercraft propulsion device 1. As one example, watercraft propulsion device 1 according to the present exemplary embodiment is a watercraft outboard motor. Watercraft propulsion device 1 may also be a watercraft inboard motor or a sterndrive. Watercraft propulsion device 1 includes upper housing 2, intermediate housing 4, and lower housing 6. Upper housing 2 is in a substantially rectangular shape and disposed at a position higher than water surface WS. Lower housing 6 is disposed at a position lower than water surface WS. Intermediate housing 4 is in a vertically extending tubular shape and connects upper housing 2 and lower housing 6 together. Intermediate housing 4 is provided with bracket device 8. Watercraft propulsion device 1 is supported on watercraft hull 100 via bracket device 8. In the present exemplary embodiment, watercraft propulsion device 1 is mounted to transom 102 of watercraft hull 100.

Watercraft propulsion device 1 is able to pivot in horizontal directions and in vertical directions. Upper housing 2 is provided with steering tiller handle 10 extending toward watercraft hull 100. A crew of the watercraft is able to change the orientation of watercraft propulsion device 1 by swinging steering tiller handle 10, to steer watercraft hull 100. A throttle grip for adjusting the output power of motor 16 is provided at a tip end of steering tiller handle 10. Steering tiller handle 10 is provided with a shift switch that changes over positive rotation and negative rotation of motor 16.

Watercraft propulsion device 1 also includes battery 12, electric power converter 14, motor 16, propulsion unit 18, and gas flow passage 20. Battery 12 is accommodated in upper housing 2. Preferably, battery 12 is detachably accommodated in upper housing 2. Battery 12 includes a plurality of battery cells 22 and battery pack 24. The plurality of battery cells 22 are accommodated in battery pack 24 in such a state as to be connected in series and/or in parallel with each other. Battery pack 24 is a container that is made of metal or resin. Battery pack 24 is preferably waterproof. It is also possible that battery 12 may include only one battery cell 22.

Examples of battery cells 22 include rechargeable secondary batteries, such as lithium-ion batteries, nickel-hydride batteries, and nickel-cadmium batteries. Each battery cell 22 has a well-known structure. In one example, battery cell 22 has a structure in which an electrode assembly, together with a non-aqueous electrolyte solution, is accommodated in an outer covering can. The outer covering can is provided with a safety valve. The safety valve opens when the internal pressure of the outer covering can increase to a predetermined value or higher. This allows the gas inside battery cells 22 to be released.

Battery 12 supplies electric power to motor 16 through electric power converter 14. In one example, electric power converter 14 is accommodated in intermediate housing 4 or lower housing 6, and motor 16 is accommodated in lower housing 6. Electric power converter 14 and motor 16 may be integrated with each other. It is also possible that electric power converter 14 may be omitted. Electric power converter 14 converts the electric power of battery 12 and supplies the converted electric power to motor 16. For example, electric power converter 14 is an inverter, which controls the voltage and the frequency of battery 12 to change the output power and the like of motor 16. It is sufficient that motor 16 is such as to be able to convert electric power supplied from battery 12 into motive power, and its structure is not limited to any particular structure.

Propulsion unit 18 is connected to motor 16. Motor 16 receives supply of electric power from battery 12 to drive motor 16 so that propulsion unit 18 can be driven. Propulsion unit 18 of the present exemplary embodiment is a propeller, which is connected to an output shaft of motor 16 via propeller shaft 26. Propulsion unit 18 may also be a well-known propulsion unit other than the propeller, such as a water jet propulsion unit. Also, electric power converter 14 and motor 16 may be accommodated in upper housing 2. When this is the case, the output shaft of motor 16 and propeller shaft 26 are connected to each other via a drive shaft accommodated in intermediate housing 4.

Gas flow passage 20 is a duct pipe for exhausting the gas ejected from battery 12 to the outside of watercraft hull 100. Gas flow passage 20 extends from the interior of upper housing 2 to the interior of lower housing 6. One end 20*a* of gas flow passage 20 communicates with battery 12. For example, battery pack 24 is provided with a through hole that allows the inside and outside of battery pack 24 to communicate with each other, and one end 20*a* is connected to this through hole.

Other end 20*b* of gas flow passage 20 communicates with a region that is outside watercraft hull 100 and is lower than the upper end of an outer panel disposed at an edge portion of watercraft hull 100. The region outside watercraft hull 100 means a region that is on water surface WS or underwater. The shell panel provided at the edge portion of watercraft hull 100 is, for example, a bulwark provided on the watercraft or transom 102 provided at a stern. Watercraft propulsion device 1 of the present exemplary embodiment is secured to transom 102. In addition, other end 20*b* of gas flow passage 20 communicates with a region that is outside watercraft hull 100 and is lower than the upper end of transom 102. Furthermore, in the present exemplary embodiment, other end 20*b* of gas flow passage 20 is disposed under water surface WS to communicate with an underwater region.

In addition, other end 20*b* of gas flow passage 20 is disposed proximate to propulsion unit 18. In one example, other end 20*b* extends along propeller shaft 26 and communicates with the underwater region. Moreover, other end 20*b* is disposed inside a rotational range of the propeller as viewed in the extending direction of propeller shaft 26. Other end 20*b* is provided with check valve 28. Check valve 28 permits fluid communication of gas from one end 20*a* to other end 20*b* but restrains fluid communication of water from other end 20*b* to one end 20*a*. This prevents water from entering the interior of battery pack 24.

When a high temperature and high pressure gas is ejected from battery cells 22, the gas flows from the interior of battery pack 24 into gas flow passage 20. The gas flowing into gas flow passage 20 is exhausted from other end 20*b* through gas flow passage 20 into a region that is underwater and near propulsion unit 18. The gas exhausted in the underwater region is immediately diffused by propulsion unit 18.

Furthermore, watercraft propulsion device 1 includes coolant flow passage 30, pump 32, and heat exchange member 34. Coolant flow passage 30 is a duct pipe through which a coolant for cooling battery 12 flows. In the present exemplary embodiment, the coolant is water that is present external to watercraft hull 100. In other words, the water in which watercraft hull 100 floats (such as sea water, lake water, and river water) may be used as the coolant.

Coolant flow passage 30 extends from the interior of upper housing 2 to the interior of lower housing 6. Coolant flow passage 30 includes first flow passage portion 30*a*, second flow passage portion 30*b*, and third flow passage portion 30*c*. First flow passage portion 30*a* extends from the interior of lower housing 6 to the interior of upper housing 2. One end of first flow passage portion 30*a* is disposed in lower housing 6 to communicate with the underwater region, and it constitutes an inlet of the coolant. First flow passage portion 30*a* extends upward within lower housing 4 to the interior of upper housing 2. Pump 32 is provided in a middle part of first flow passage portion 30*a*. It is possible to use a well-known pump as pump 32. Pump 32 is driven by electric power supplied from battery 12 to pump up the coolant from one end of first flow passage portion 30*a*. It is also possible that pump 32 may be provided in third flow passage portion 30*c*. In addition, pump 32 may be driven by rotation of motor 16 or by rotation of the drive shaft.

Second flow passage portion 30*b* is disposed in upper housing 2. The other end of first flow passage portion 30*a* is connected to one end of second flow passage portion 30*b*. Second flow passage portion 30*b* is heat-exchangeably connected to heat exchange member 34. Heat exchange member 34 is heat-exchangeably connected to battery 12. Accordingly, coolant flow passage 30 is heat-exchangeably connected to battery 12 via heat exchange member 34.

Heat exchange member 34 may be a well-known heat exchange member. For example, heat exchange member 34 is composed of a plate material that shows high thermal conductivity, such as a metal plate. Second flow passage portion 30*b* is secured to one main surface of heat exchange member 34 by a thermally conductive adhesive agent or the like. Note that second flow passage portion 30*b* and heat exchange member 34 may be secured to each other by screw-fastening with being in direct contact with each other or with a heat transfer material being interposed therebetween, or may be secured by bonding with welding or brazing. Battery 12 is placed on the other main surface of heat exchange member 34, and the bottom surface of battery pack 24 is in contact with heat exchange member 34. The method of heat-exchangeably connecting coolant flow passage 30 and battery 12 is not limited to the above-described example. For example, heat exchange member 34 may be omitted.

Third flow passage portion 30*c* extends from the interior of upper housing 2 to the interior of lower housing 6. One end of third flow passage portion 30*c* is disposed in upper housing 2 and is connected to the other end of second flow passage portion 30*b*. Third flow passage portion 30*c* extends downward within intermediate housing 4 to the interior of lower housing 6. The other end of third flow passage portion 30*c* is disposed in lower housing 6 to communicate with the underwater region, and it constitutes an outlet of the coolant. The coolant pumped up by pump 32 from the one end of first flow passage portion 30*a* is passed through first flow passage portion 30*a*, second flow passage portion 30*b*, and third flow passage portion 30*c*, and is discharged from the other end of third flow passage portion 30*c*. In the process of passing through second flow passage portion 30*b*, the coolant transfers heat away from battery 12 through heat exchange member 34. This causes battery 12 to be cooled.

Figure 2A:
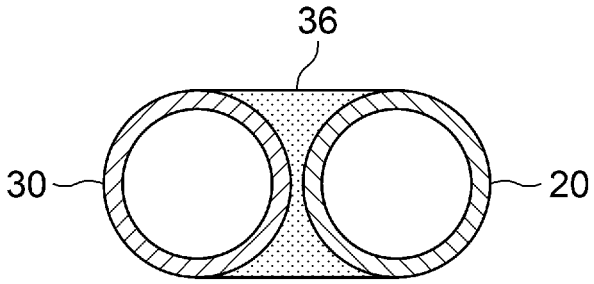
FIG. 2A is a schematic view illustrating a connection configuration of a gas flow passage and a coolant flow passage.
Figure 2B:
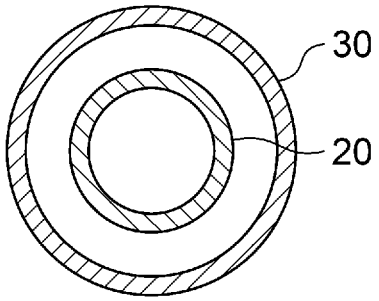
FIG. 2B is a schematic view illustrating another connection configuration of the gas flow passage and the coolant flow passage.
Figure 2C:
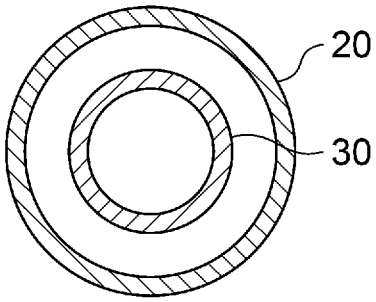
FIG. 2C is a schematic view illustrating yet another connection configuration of the gas flow passage and the coolant flow passage.

Gas flow passage 20 of the present exemplary embodiment is heat-exchangeably connected to coolant flow passage 30. In one example, gas flow passage 20 is heat-exchangeably connected to third flow passage portion 30*c* in intermediate housing 4. FIGS. 2A to 2C are schematic views each illustrating a connection configuration of gas flow passage 20 and coolant flow passage 30.

For example, as illustrated in FIG. 2A, the outer surface of gas flow passage 20 and the outer surface of coolant flow passage 30 are thermally coupled with each other by heat transfer material 36. Examples of heat transfer material 36 include thermally conductive adhesive agents, brazing materials, and soldering materials. The outer surfaces of the two flow passages may be directly in contact with each other, or heat transfer material 36 may be interposed therebetween. Heat transfer material 36 interposed between the two flow passages may also be interpreted as a heat exchange member. It is also possible to interpose a heat exchange member other than heat transfer material 36 between the two flow passages. In addition, gas flow passage 20 and coolant flow passage 30 may be thermally coupled to each other by being wrapped with a sheet material or the like to be bundled together.

Alternatively, as illustrated in FIG. 2B, gas flow passage 20 may be inserted through coolant flow passage 30 to form a double pipe structure so that gas flow passage 20 and coolant flow passage 30 can be thermally connected together. On the other hand, as illustrated in FIG. 2C, coolant flow passage 30 may be inserted through gas flow passage 20 to form a double pipe structure so that gas flow passage 20 and coolant flow passage 30 can be thermally connected together. The connection configurations shown in FIGS. 2A to 2C are illustrative examples, and the method of heat-exchangeably connecting gas flow passage 20 and coolant flow passage 30 is not limited to a particular method.

In the present exemplary embodiment, electric power converter 14 and motor 16 are also heat-exchangeably connected to coolant flow passage 30. For example, electric power converter 14 and motor 16 may be heat-exchangeably connected to third flow passage portion 30*c*. Each of electric power converter 14 and motor 16 may be heat-exchangeably connected to third flow passage portion 30*c* in a similar method to the method of connecting second flow passage portion 30*b* and heat exchange member 34. This allows electric power converter 14 and motor 16 to be likewise cooled by the coolant. It should be noted that the thermal connection of electric power converter 14 and motor 16 to coolant flow passage 30 is optional.

As described hereinabove, watercraft propulsion device 1 according the present exemplary embodiment includes motor 16 that drives propulsion unit 18, battery 12 that supplies electric power to motor 16, and gas flow passage 20 including one end 20*a* that communicates with battery 12 and another end 20*b* that communicates with a region that is outside watercraft hull 100 and is located lower than the upper end of a shell panel disposed at an edge of watercraft hull 100, the gas flow passage exhausting a gas ejected from battery 12 from other end 20*b* to outside of watercraft hull 100.

With such a configuration, when battery cells 22 in battery pack 24 ignite due to an internal short circuit or other causes and high temperature and high pressure gas is ejected from battery cells 22, the gas can be exhausted through gas flow passage 20 to the outside of watercraft hull 100. Moreover, the gas can be exhausted to a region lower than the upper end of the shell panel that surrounds watercraft hull 100. This reduces the risk of the gas ejected from battery 12 blowing onto crews or passengers of the watercraft. As a result, it is possible to improve safety of watercraft propulsion device 1.

In addition, other end 20*b* of gas flow passage 20 of the present exemplary embodiment is allowed to communicate with an underwater region. This allows the gas ejected from battery cells 22 to be released into water. Therefore, it is possible to more reliably prevent the gas from blowing onto crews or passengers. Furthermore, the gas emitted outside watercraft propulsion device 1 can be cooled immediately. Thus, it is possible to further improve safety of watercraft propulsion device 1.

In addition, other end 20*b* of gas flow passage 20 of the present exemplary embodiment is disposed proximate to propulsion unit 18. This enables the gas released into water to be diffused immediately. This prevents the gas released into water from floating above water surface WS in a clump form. As a result, it is possible to further improve safety of watercraft propulsion device 1.

Watercraft propulsion device 1 of the present exemplary embodiment further includes coolant flow passage 30 in which a coolant flows and that is heat-exchangeably connected to battery 12. Gas flow passage 20 is heat-exchangeably connected to coolant flow passage 30. This allows the gas to be cooled before the gas is released outside watercraft propulsion device 1. As a result, it is possible to still further improve safety of watercraft propulsion device 1. Moreover, the coolant for cooling battery 12 can be utilized to cool the gas. Furthermore, the coolant of the present exemplary embodiment is water external to watercraft hull 100. These can achieve a gas cooling mechanism at lower cost.

Hereinabove, exemplary embodiments of the present disclosure have been described in detail. The foregoing exemplary embodiments are merely illustrative examples of implementations of the present disclosure. The exemplary embodiments do not limit the technical scope of the present disclosure, and many various design modifications, such as changes, additions, and deletions of the constituent elements, may be made without departing from the scope of the present disclosure as defined by the appended claims. Alternative exemplary embodiments to which design modifications are made exhibit advantageous effects of both the combined exemplary embodiments and modifications. Although in the above-described exemplary embodiments, such elements to which design modifications are possible are designated and emphasized with the phrases such as "of the present exemplary embodiment" and "in the present exemplary embodiment", design modifications are also permitted to those elements that are not designated with such phrases. Any combinations of the above-described constituent elements are also valid as aspects of the present disclosure. The hatching present on the cross sections appearing in the drawings is not intended to limit the material of the hatched objects.

The exemplary embodiments may be embodied by the following items.

[Item 1] A watercraft propulsion device (1) including:

a motor (16) that drives a propulsion unit (18);

a battery (12) that supplies electric power to the motor (16); and a gas flow passage (20) including one end (20*a*) and another end (20*b*), the one end (20*a*) communicating with the battery (12) and the other end (20*b*) communicating with a region that is outside a watercraft hull (100) and is located lower than an upper end of a shell panel (102) disposed at an edge of the watercraft hull (100), the gas flow passage (20) exhausting a gas ejected from the battery (12) from the other end (20*b*) to outside of the watercraft hull (100).

[Item 2] The watercraft propulsion device (1) according to item 1, wherein the other end (20*b*) of the gas flow passage (20) communicates with an underwater region.

[Item 3] The watercraft propulsion device (1) according to item 2, wherein the other end (20*b*) of the gas flow passage (20) is disposed proximate to the propulsion unit (18).

[Item 4] The watercraft propulsion device (1) according to any one of items 1 through 3, further including:

a coolant flow passage (30) in which a coolant flows and that is heat-exchangeably connected to the battery (12), and wherein the gas flow passage (20) is heat-exchangeably connected to the coolant flow passage (30).

[Item 5] The watercraft propulsion device (1) according to item 4, wherein the coolant is water external to the watercraft hull (100).

REFERENCE MARKS IN THE DRAWINGS

1 watercraft propulsion device
12 battery
16 motor
18 propulsion unit
20 gas flow passage
20*a* one end
20*b* other end
30 coolant flow passage
100 watercraft hull

The invention claimed is:

1. A watercraft propulsion device comprising:

a motor driving a propulsion unit;

a battery supplying electric power to the motor; and a gas flow passage including one end and other end, the one end communicating with the battery and the other end communicating with a region that is outside a watercraft hull and is located lower than an upper end of a shell panel disposed at an edge of the watercraft hull, the gas flow passage being a passage through which a gas ejected from the battery is exhausted from the other end to outside of the watercraft hull, characterized in that the watercraft propulsion device comprises:

an upper housing accommodating the battery, the battery including a plurality of battery cells and battery pack;

a lower housing accommodating the motor;

an intermediate housing connecting the upper housing and the lower housing;

a heat exchange member heat-exchangeably connected to the battery; and a coolant flow passage for cooling the battery, wherein the coolant flow passage includes a first flow passage portion, a second flow passage portion and a third flow passage portion, the first flow passage portion extending from the interior of the lower housing to the interior of the upper housing, the second flow passage portion being heat-exchangeably connected to the heat exchange member and the third flow passage portion extending from the interior of the upper housing to the interior of the lower housing, and the gas flow passage and the third flow passage portion are heat-exchangeably connected in the intermediate housing.

2. The watercraft propulsion device according to claim 1, wherein the other end of the gas flow passage communicates with water.

3. The watercraft propulsion device according to claim 2, wherein the other end of the gas flow passage is disposed proximate to the propulsion unit.

4. The watercraft propulsion device according to claim 1, wherein a coolant flows in the coolant flow passage, and wherein the coolant is water external to the watercraft hull.

5. The watercraft propulsion device according to claim 1, wherein the propulsion unit is a propeller.

* * * * *